US005853355A

United States Patent [19]

Standish

[11] Patent Number: 5,853,355

[45] Date of Patent: Dec. 29, 1998

[54] MANIPULATABLE WEIGHT PLATE

[75] Inventor: Victor J. Standish, Lancaster, Pa.

[73] Assignee: York Barbell Co., Inc., York, Pa.

[21] Appl. No.: 798,225

[22] Filed: Feb. 11, 1997

[51] Int. Cl.[6] ..... A63B 21/072

[52] U.S. Cl. ..... 482/106; D21/197

[58] Field of Search ..... 482/105, 106, 482/108, 93, 107, 109, 132; D21/191, 196–198

[56] References Cited

U.S. PATENT DOCUMENTS

| | | | |
|---|---|---|---|
| D. 194,042 | 11/1962 | Guthormsen | D34/5 |
| D. 203,052 | 11/1965 | Erhard . | |
| D. 230,752 | 3/1974 | Speyer . | |
| D. 354,322 | 1/1995 | Vodhanel | D21/196 |
| D. 355,007 | 1/1995 | Rojas et al. | D21/196 |
| 3,771,785 | 11/1973 | Speyer | 482/106 |
| 4,799,673 | 1/1989 | Selle . | |
| 5,137,502 | 8/1992 | Anastasi | 482/106 |
| 5,221,244 | 6/1993 | Doss | 482/106 |
| 5,250,014 | 10/1993 | Chang | 482/106 |
| 5,344,375 | 9/1994 | Copper . | |
| 5,407,413 | 4/1995 | Kupferman | 482/106 |
| 5,628,716 | 5/1997 | Brice | 482/106 |

*Primary Examiner*—Stephen R. Crow

*Attorney, Agent, or Firm*—Sixbey, Friedman, Leedom & Ferguson; Charles M. Leedom, Jr.; Leonard Smith

[57] ABSTRACT

A highly manipulatable weight plate for use in human exercise includes a disk body having a mass sufficient to generate a human movement resistance force when employed in human exercise and containing at least one internally located bore having a central axis for receiving a disk body mounting apparatus such as a barbell or dumbbell. The disk body includes two generally opposed sides that are oriented generally radially with respect to the central axis and terminate in circumferential edges. An outer periphery surface extends between the circumferential edges of the two sides. At least one recess is contained in the disk body and opens into the outer periphery surface to allow radial insertion of at least one human finger therein so that the finger can apply an axial force against the disk body to displace the disk body away from an adjacent surface that is contacting one of the sides of the disk body. Examples of such an adjacent surface include a floor and a similarly sized weight plate.

19 Claims, 6 Drawing Sheets

MANIPULATABLE WEIGHT PLATE

TECHNICAL FIELD OF THE INVENTION

The present invention generally relates to physical fitness equipment and more specifically, to weight plates used during weight lifting.

BACKGROUND OF THE PRESENT INVENTION

Weight plates for use with barbells and dumbbells are generally disc-shaped and have an opening in the center for mounting the weight plate onto a barbell or dumbbell bar. Typically, such weight plates are made of iron and one or both sides of the generally disc-shaped plate are flat. Some plates, such as, for example, Olympic style weight plates, include a first flat side and a second side having a continuous raised flange extending about a perimeter of the second side of the plate. These weight plates, often referred to as "deep-dish" style Olympic plates, are often used in clubs and gyms.

One problem frequently experienced with such weight plates is that they are difficult to pick up or maneuver when they are lying flat against an adjacent hard surface, such as a floor or another weight plate. For example, when such a weight plate is stacked against another adjacent plate of the same size on a bar, a weight machine, or weight rack, it is difficult to remove the plate. Generally, this problem occurs because the plate evenly abuts the adjacent surface such that no gaps are left to permit a person to sufficiently grip the plate so as to move it easily. That is, due to the inability of a person to fit their fingers between the plate and the adjacent surface, is it extremely difficult to obtain sufficient leverage to permit easy movement of the weight plate. Furthermore, where the plate is laying flat on a smooth flooring surface, such as a weight mat or the like, it can be practically impossible to pick the weight up without scooting it across the floor to a location where a user can get his fingers under the weight to gain a sufficient mechanical advantage to pick the weight up.

These problems are amplified when the size of the weight increases. For example, with lower weights, such as 5 or 10 pound weight plates, sufficient frictional force on the outer perimeter of the disc-like weight plate can often be generated by some individuals to allow the plate to be lifted from an adjacent flat surface provided the individual is able also to apply sufficient radial force to prevent his fingers through frictional contact from sliding off the perimeter of the weight plate. When the size of the weight plate increase to 35 or 45 pounds, however, most users can no longer generate sufficient frictional contact through the application of radial force to lift the plate high enough to allow their fingers to be placed below the plate. In fact, when attempting to lift such a plate from the floor, a person often has to place his toes on one edge of the plate to stop it from sliding as he tries to lift an opposite edge using his finger tips. Lifting a weight plate in this manner can cause the weight to unexpectedly slip and fall painfully on finger tips placed under the weight. Moreover, this type of lifting requires a person to bend at his waist and to place both radial and axial force on the weight plate that may cause strain on the persons back. Even at lower weight values, these problems can occur for people of smaller stature or individuals having longer fingernails that make it difficult to grasp the edges of the plate.

These problems are even further exacerbated by the fact that it is very common for individuals of even smaller stature to use heavier weights, such as 45 pound weights, when using machines such as a leg press machine. This is true because people's leg muscles are relatively strong as compared to the rest of their muscles. Leg press machines often include bars for receiving weight plates on each side of a raised movable sled. To increase the resistance of the leg press machine, weight plates are loaded onto these bars. In particular, each weight plate must be positioned to cause the plate's bore to be aligned with one end of the bar to allow the weight plate to moved axially onto the bar. Since the moveable sled is often raised above waist level, a person must use their upper body including their arms and hands to lift the weight plate and to place the weight plate on the bars of the machine. Furthermore, due to the higher location, removal of the weights from the machine is difficult, even without the problems noted above in gripping the weight plates.

As noted above, some weight plates include a raised flange formed around the periphery of one side of the plate. While this flange enables a person to grip the weight plate with their fingers in order to more easily lift and carry the plate, the flange does not entirely overcome the problems noted above, particularly where the weight plate is left in a "face-down" position with the flange abutting the floor or another adjacent weight. In such circumstances, an individual is still confronted with the difficulty of raising an edge of the plate sufficiently to allow his or her fingers to be inserted under the plate to gain adequate hold allowing the plate to be lifted from the adjacent surface.

U.S. Pat. No. 5,344,375 to Cooper discloses a weight having an oval opening which forms a handle. However, if this weight was lying on a flat surface such as a floor, the oval opening does not allow a person to place their fingers between the floor and the weight plate. Thus, the person must use their finger tips to attempt to lift the plate off a flat surface.

U.S. Design Pat. No. 194,042 issued to Guthormsen discloses an ornamental weight plate having a staggered cross section. Referring to FIG. 2, it appears that each side of the plate has four projections located 90 degrees from one another. This design patent does not suggest or imply that the projections are of sufficient height to enable a user to place their fingers between the plate and an adjacent surface in order to aid in maneuvering of the plates. It even appears from FIG. 1 that if two of these plates are of similar size and stacked on a bar against each other, that the projections on one plate would line up between projections on an adjacent plate causing an interlocking of the two plates and thus not allowing a person to easily fit their fingers between the two plates.

U.S. Design Pat. No. 355,007 to Royas et al. discloses an ornamental weight-lifting plate having a raised flange on both sides of the plate and pair of diametrically opposed openings within the plate. However, this reference does not disclose a plate having finger insets that are located along the outer circumference of the plate. In addition, this reference does not disclose that if this plate was lying against a flat adjacent surface, a plurality of fingers would be able to fit through the openings and between the adjacent surface and the plate in order to ease lifting or sliding of the plate. Furthermore, this reference does not disclose distinct and separate finger recesses on both sides of the plate.

SUMMARY OF THE INVENTION

It is an object of the present invention to provide a weight plate that is easy and safe to manually grip and move about regardless of its position relative to adjacent supportive and/or contacting surfaces.

It is additionally an object of the present invention to provide a weight plate that is easy to lift from a flat adjacent surface such as a floor.

It is also an object of the present invention to provide a weight plate that is easy to remove from a bar, machine, or rack when the weight plate is adjacent to another weight plate of similar size.

It is another object of the present invention to provide a weight plate that has at least one recess that enables a person to place at least one finger between a plurality of plates that are engaged on a bar, machine, or rack so that the person may more easily remove and maneuver the outer most plate.

It is still another object of the present invention to provide a weight plate that has at least one recess that enables a person to place at least one finger between the plate and an adjacent flat surface such as a floor so that the person may more easily lift and maneuver the plate.

It is additionally an object of the present invention to provide a weight plate that has a plurality of recesses to enable a person to place their fingers between the plate and an adjacent plate in order to more easily remove and maneuver the outer most plate, regardless of which side of the plate is against the adjacent plate.

It is an object of the present invention to provide a weight plate that has a plurality of recesses that enables a person to place their fingers between the plate and an adjacent flat surface such as a floor so that the person may more easily lift and maneuver the plate, regardless of which side of the plate is against the floor.

It is also an object of the present invention to provide an Olympic style wight plate having two raised flanges and recesses within each raised flange.

These and other objects of the present invention are achieve by providing a weight plate consisting of a disk body having a mass sufficient to generate a human movement resistance force when used in human exercise such as weight lifting. The disk body has at least one recess within an outer periphery surface of the disk body wherein the recess allows a person to fit at least one finger between the disk body and an adjacent surface so the person can apply an axial force against the disk body to displace the disk body from an adjacent surface contacting a side of the disk body.

DETAILED DESCRIPTION OF THE PREFERRED EMBODIMENTS

Figure 1:
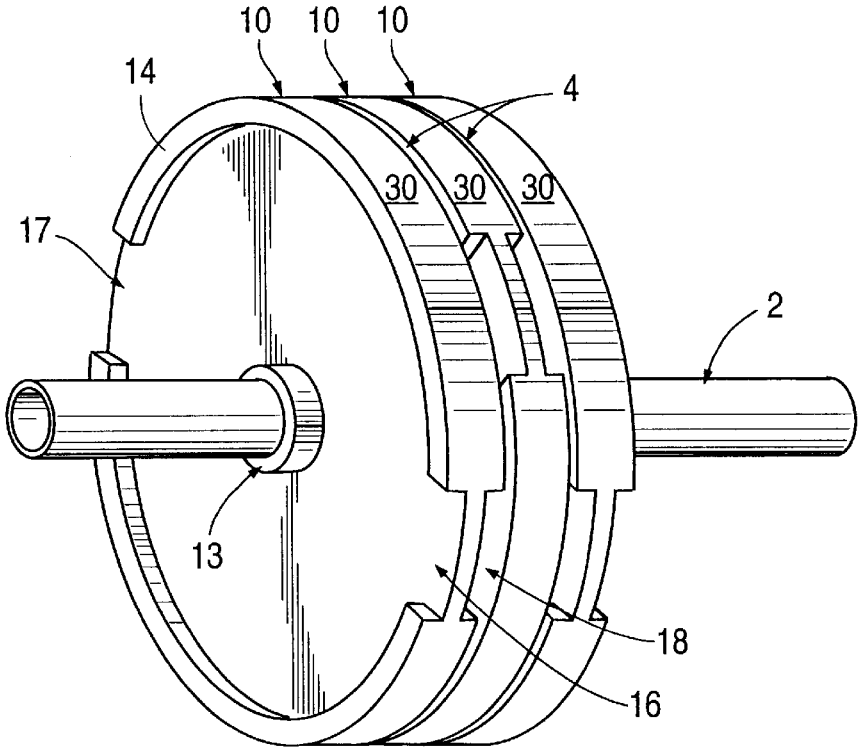
FIG. 1 is a perspective view of one embodiment of plural weight plates formed in accordance with the present invention mounted on one end of a barbell.

FIGS. 1–7 illustrate one embodiment of the p resent invention. FIG. 1 illustrates three weight plates of the present invention adjacent to one another and mounted on one end of a barbell 2. The weight plates include a disk body 10 having a mass sufficient to generate a human movement resistance force when employed in human exercise. Each disk body 10 contains at least one internally located bore 13 having a central axis, specified by line 22, for receiving a disk body mounting apparatus such as one end of the barbell 2. When the disk bodies 10 are flush against one another, there is substantially no space between the outer periphery surfaces 30 of the disk bodies at locations specified by 4. Thus at locations 4, it is difficult if not impossible for a person to place one or more fingers between the abutting disk bodies so that they may slide the outer most weight plate from the barbell 2. Recess 18 provides a space for a person to fit a plurality of their fingers between adjacent disk bodies 10 to aid in the removing and maneuvering of the outer most weight plate.

Figure 2:
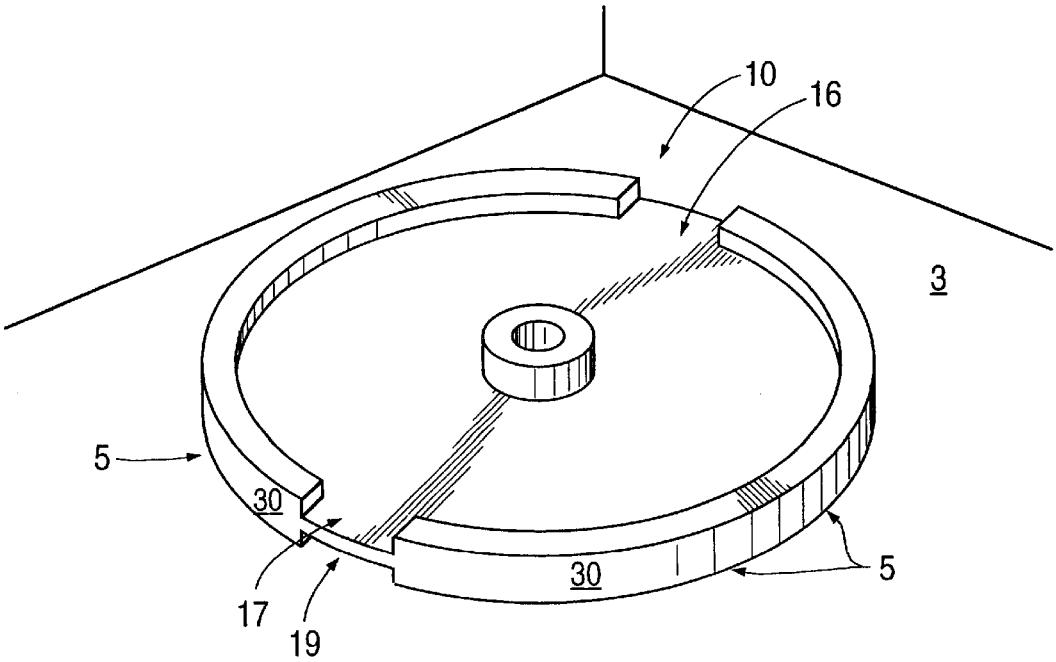
FIG. 2 is a perspective view of one of the weight plates illustrated in FIG. 1 lying flat on a floor.
Figure 3:
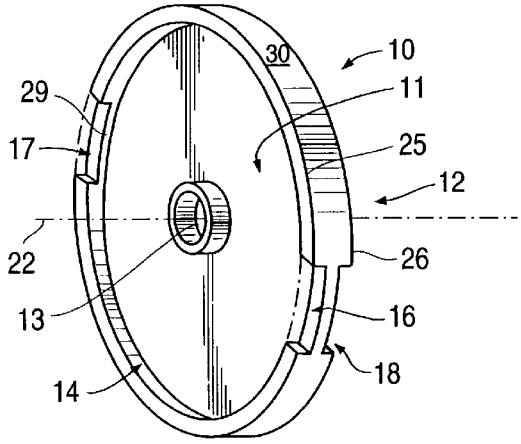
FIG. 3 is a perspective view of one embodiment of a weight plate formed in accordance with the present invention.
Figure 4:
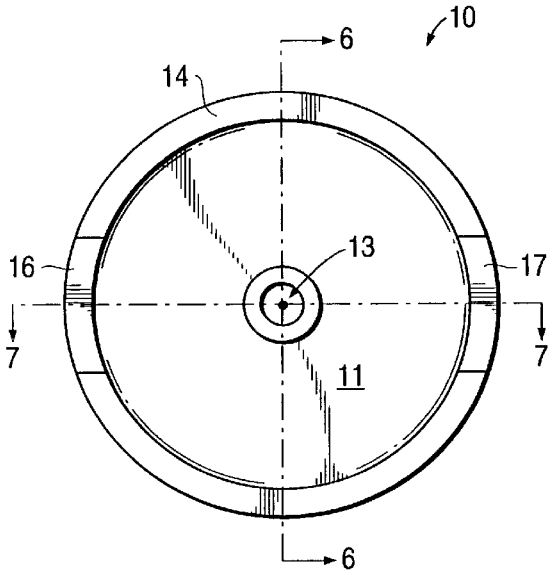
FIG. 4 is a front view of the weight plate shown in FIG. 3.
Figure 5:
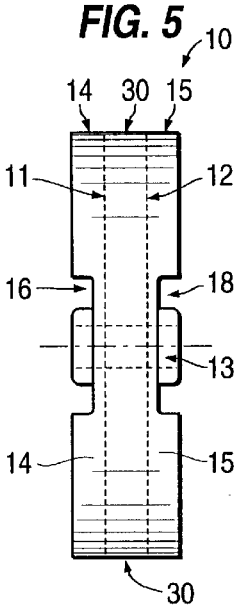
FIG. 5 is a side view of the weight plate shown in FIG. 4.
Figure 6:
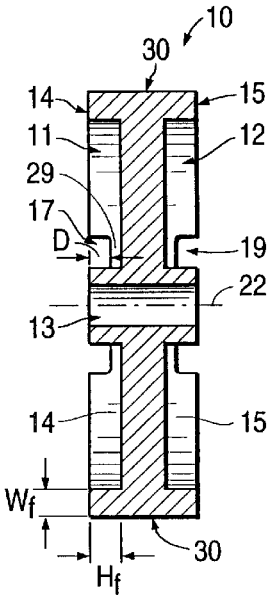
FIG. 6 is a cross-sectional side view of the weight plate shown in FIG. 4 taken along line 6—6.
Figure 7:
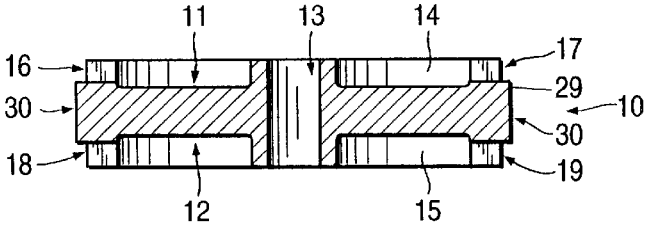
FIG. 7 is a cross-sectional side view of the weight plate in shown in FIG. 4 taken along line 7—7.
Figure 8:
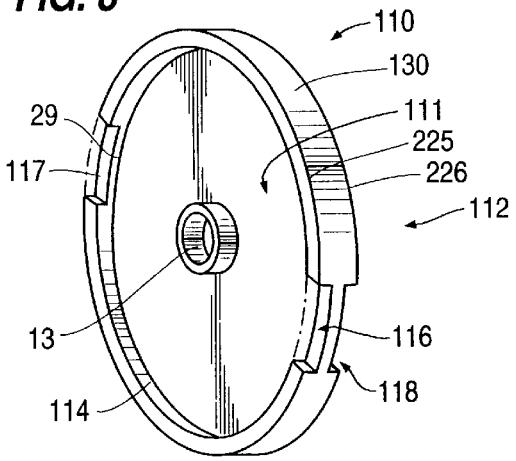
FIG. 8 is a perspective view of another embodiment of a weight plate formed in accordance with the present invention.
Figure 9:
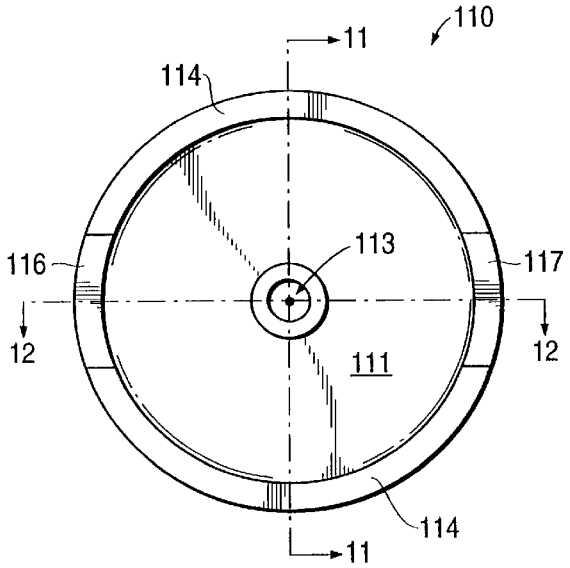
FIG. 9 is a front view of the weight plate shown in FIG. 8.
Figure 10:
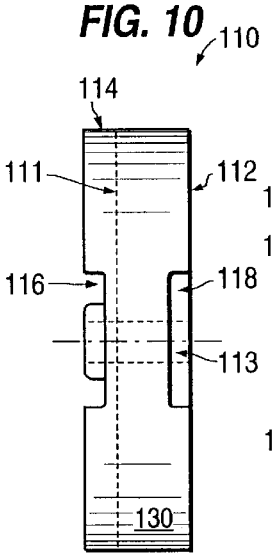
FIG. 10 is a side view of the weight plate shown in FIG. 9.
Figure 11:
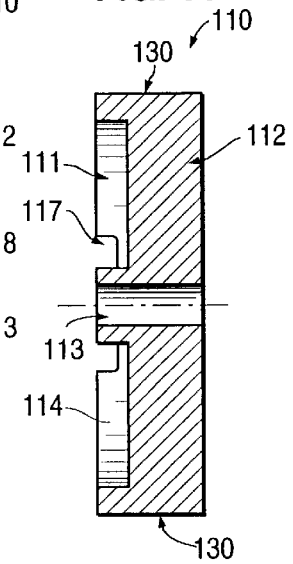
FIG. 11 is a cross-sectional side view of the weight plate shown in FIG. 9 taken along line 11—11.
Figure 12:
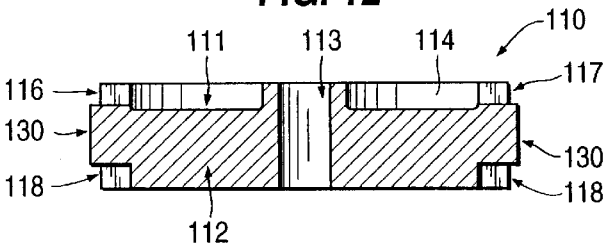
FIG. 12 is a cross-sectional side view of the weight plate shown in FIG. 9 taken along line 12—12.

FIG. 2 illustrates the weight plate of the present invention lying flat on a floor 3. There is no space at locations 5 between the floor 3 and an outer periphery surface 30 of the disk body 10. Thus at locations 5, it is difficult if not impossible for a person to fit their fingers between the disk body 10 and the floor 3 so that they may pick the weight plate off the floor 3. Recess 19 provides a space for a person to fit their fingers between the floor 3 and the disk body 10 to aid in the lifting and maneuvering of the weight plate. If the disk body 10 did not have the recesses, a person must either attempt to create a frictional force between their finger tips and the outer periphery surface 30 of the disk body 10 or attempt to grip flange 14 in order to slide the outer most weight plate from the barbell 2 or to lift the weight plate from the floor 3.

FIGS. 4–7 illustrate additional details of the weight plate shown in FIGS. 1 and 2. The weight plate has a disk body 10 having a first side 11 and a second side 12 that are generally opposed and oriented generally radially with respect to a central axis of the bore 13. The bore 13 is internally located within the disk body 10. The central axis of the bore is for receiving a disk body mounting apparatus such as one end of a barbell or dumbbell. The bore 13 may be of different diameters to accommodate different barbells and dumbbells. In one embodiment, the diameter of the bore 13 is approximately 2 inches so that it may engage an Olympic style barbell. Additionally, in one embodiment of the invention the bore 13 is located in a center of the disk body 10.

The first and second sides 11 and 12 terminate in first and second circumferential edges, 25 and 26 respectively. The outer periphery surface 30 extends between the first and second circumferential edges 25 and 26 of the first and second sides 11 and 12.

At least one recess 16, 17, 18, or 19 is contained in the disk body 10 and opening into the outer periphery 30 of the disk body 10. The recesses 16, 17, 18 and 19 are dimensioned so that at least one finger of a human hand can be radially inserted within the recesses when the weight plate is flat against an adjacent surface such as a floor 3 or a similarly sized weight plate. When the weight plate is lying flat on the floor 3 the recesses enable a person to fit their fingers between the floor and the side 11 or 12 of the disk body 10 that is facing the floor so that the person may more easily lift the weight plate from the floor 3. When the weight plate is mounted on a barbell, machine, or rack and is adjacent to another similar sized weight plate, the recesses enable a person to fit their fingers between the adjacent weight plate and the side 11 or 12 of the disk body 10 that is facing the adjacent plate so that the person may more easily remove the weight plate from the barbell, machine, or rack. By allowing insertion of at least one human finger within the recess 16, 17, 18, or 19 the person may apply a radial force with their finger(s) against the disk body 10 to displace the disk body 10 from an adjacent surface contacting either of the sides 11 or 12. The recesses 16, 17, 18, or 19 may be of different sizes. In one embodiment the recess is large enough to allow four fingers of a human hand to be inserted therein. Additionally, the disk body may contain a single recess or a plurality or recesses.

In one embodiment, raised flanges 14 and 15 are disposed about the perimeters of the disk body 10. Recesses 16 and 17 are formed by notches in raised flange 14. Recesses 17 and 18 are formed by notches in raised flange 15. The raised flanges 14 and 15 may provide structural support for the disk body 10 and may also serve to make it easier for fingers of a human hand to grip and maneuver the weight plate. The raised flanges 14 and 15 may be of different radial widths $W_f$ and different axial extents $H_f$. In one embodiment, the radial width $W_f$ and the axial extent $H_f$ of the flanges at a cross section of the weight plate are substantially the same as at any other cross section, except where the cross section intersects a recess. In one embodiment, the axial extent $H_f$ of the flange is ¾ inches. In one embodiment the recess(es) contained in the raised flange(s) have a depth D that is less than the axial extent $H_f$ so that a lip 29 having an axial extent less than $H_f$ is located adjacent to the recess to allow the finger(s) to apply an outward radial force against the disk body to aid in grasping of the disk body.

In one embodiment, each of the raised flanges 14 and 15 have two notches forming recesses that are located 180 degrees form one another. In one embodiment, each of the recesses 16 and 17 in the first raised flange 14 have an opposing recess in the second raised flange, i.e. recess 18 opposes recess 16, and recess 19 opposes to 17.

The weights 10 may comprise a suitable metal, such as iron. The weight 10 may be covered with a coating (not shown) for comfort when gripping the weight 10. The weight 10 may also comprise a rigid plastic shell filled with sand.

FIGS. 8–12 illustrate another embodiment of the present invention. In this embodiment, only the first side 111 of the weight plate 110 has a raised flange 114. The second side 112 of the weight plate is substantially flat. A bore 113 is internally located within the disk body 110. A weight plate having a raised flange 114 on only one of its sides is often referred to as being a "deep dish" style weight plate. Recesses 116 and 117 formed by notches in the raised flange 114. The first and second sides 111 and 112 terminate in first and second circumferential edges, 125 and 126 respectively. An outer periphery surface 130 extends between the first and second circumferential edges 125 and 126 of said first and second sides 111 and 112. Recesses 117 and 118 open radially into the outer periphery surface 130 and axially into the first side 112.

Figure 13:
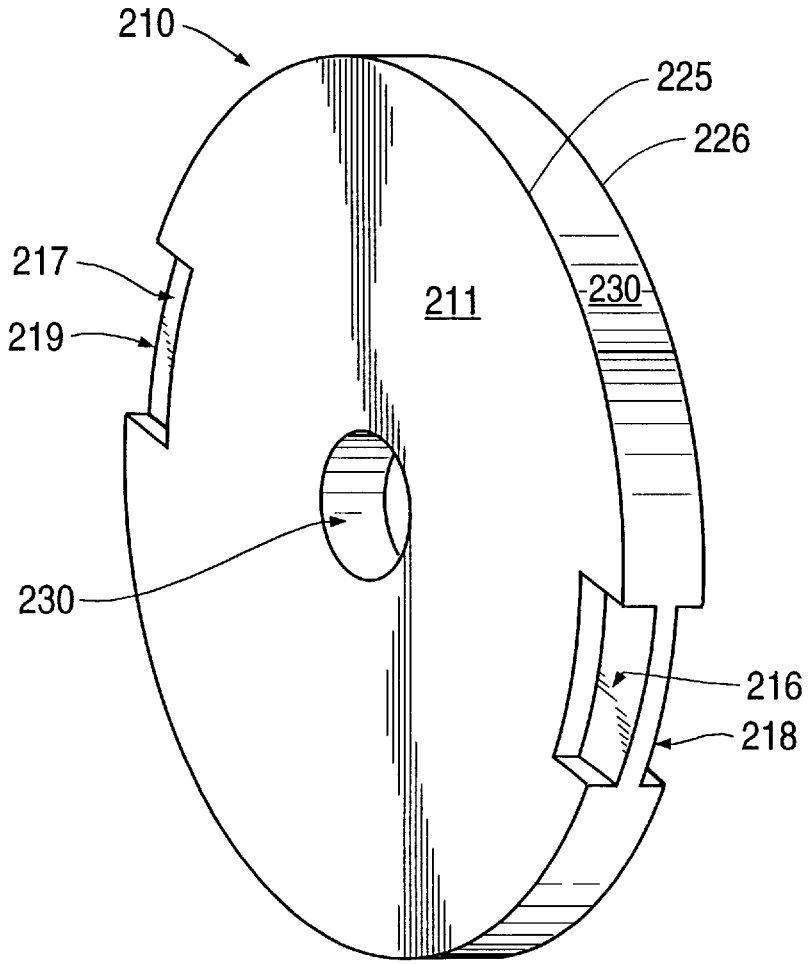
FIGS. 13, 14, 15, & 16 are perspective views of additional embodiments of the present invention.

FIG. 13 illustrates a weight plate that is a further embodiment of the present invention. The weight plate has a substantially flat first side 211 and second side 212 (not visible) that generally oppose one another. Second side 212 looks substantially the same as first side 211. A bore 213 is internally located in disk body 210 for engaging a barbell or dumbbell bar. An outer periphery surface 230 extends between circumferential edges 225 and 226 of the first and second sides 211 and 212, respectively. Recesses 216 and 217 open radially into the outer periphery surface 230 and axially into the first side 211. Recesses 218 and 219 (not visible) open radially into the outer periphery surface 230 and axially into the second side 212.

Figure 14:
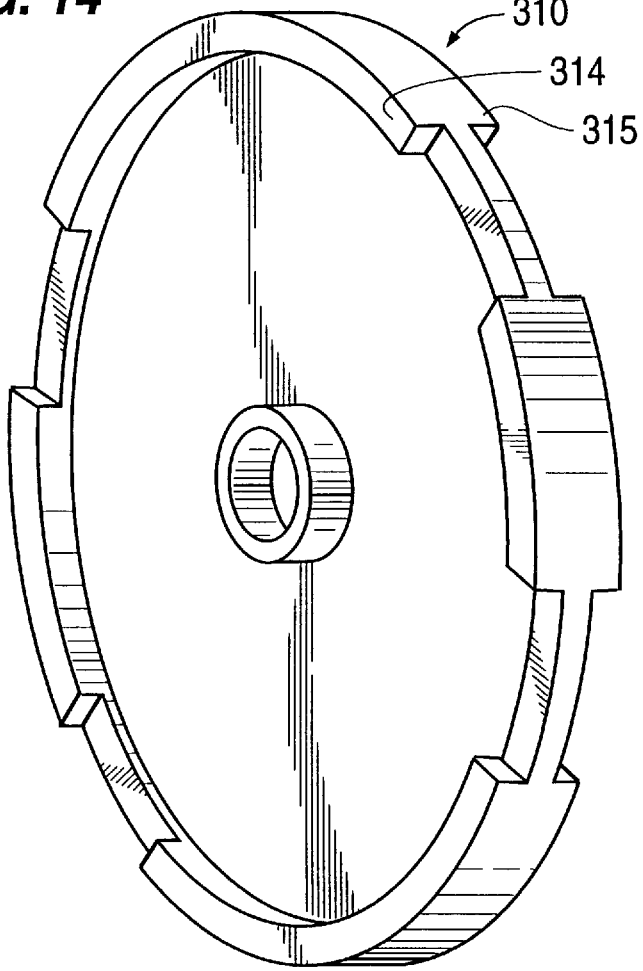

FIG. 14 illustrates still another embodiment of the present invention. In this embodiment their are four distinct recesses on each side 311 and 312 of weight plate 310. This purpose of this illustration is to show that the number of recesses on each side of a weight plate is variable.

Figure 16:
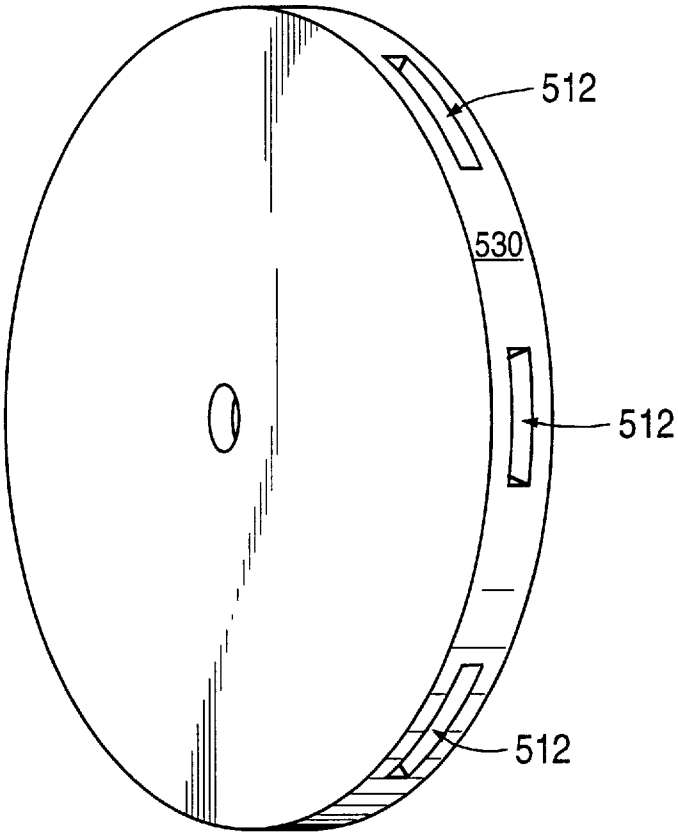
Figure 15:
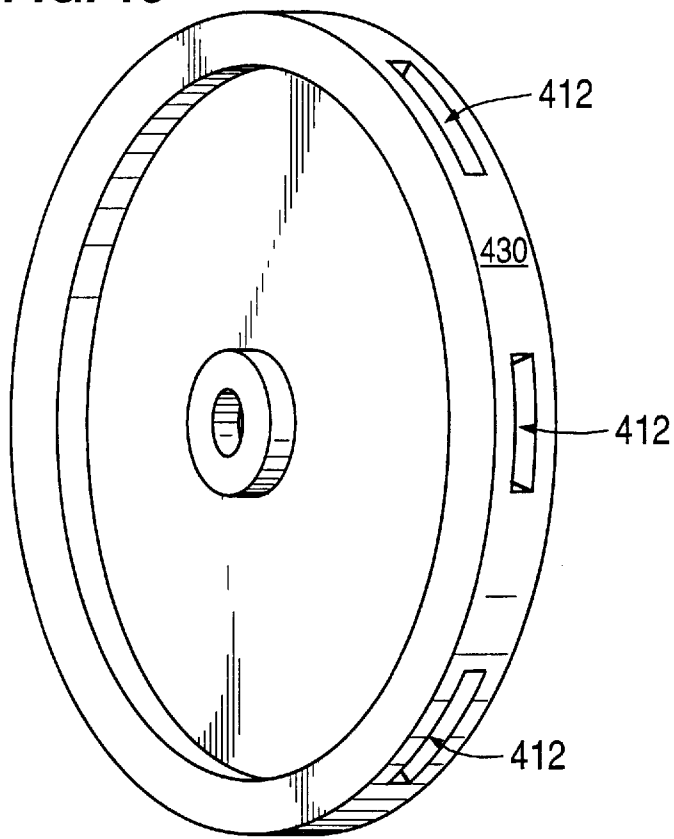

FIGS. 15 and 16 illustrate other embodiments of the present invention. The recesses in these embodiments are formed by indents 412 and 512 in the outer periphery surfaces 430 and 530, respectively. These recesses open solely into the outer periphery surfaces to allow radial insertion of at least one human finger therein so that the finger can apply an axial force against disk bodies in either of two opposite axial directions in order to displace the disk body away from an adjacent surface contacting one of the sides depending on the direction required to move the disk body away from the contacting surface.

Recesses as shown in all of the embodiments can take a variety of different forms. The purpose of the recesses are to provide a gripping means for allowing a human to place his finger(s) radially inward of a first circumferential edge of a first side of a weigh plate disk body so that the finger(s) can apply an axial force against the disk body to displace the disk body from an adjacent flat surface contacting a second side of the disk body.

As can be seen from the foregoing, a weight plate in accordance with certain embodiments of the present invention allows a person to fit their fingers between the weight plate and an adjacent surface in order to more easily lift and maneuver the weight plate. A weight plate in accordance with other embodiments of the present invention allows a person to fit there fingers within recesses formed by indents in an outer periphery surface of the weight plate in order to enable a person to more easily lift and maneuver the weight plate.

It is intended that all matter contained in the above description or shown in the accompanying drawings shall be interpreted as illustrative and not in a limiting sense.

I claim:

1. A highly manipulatable weight plate for use in human exercise, comprising:

a disk body having a mass sufficient to generate a human movement resistance force when employed in human exercise and containing at least one internally located bore having a central axis for receiving a disk body mounting apparatus, said disk body including first and second generally opposed sides oriented generally radially with respect to said central axis and terminating in first and second circumferential edges, respectively;

an outer periphery surface extending between said first and second circumferential edges of said first and second sides; and at least one recess contained in said disk body and opening into said outer periphery surface wherein the central axis of said recess intersects the central axis of said central bore, said recess is sufficiently large to receive four fingers of a typical adult male human and said recess allows radial insertion of a plurality of human fingers simultaneously therein so that the fingers can apply an axial force against said disk body to displace the disk body away from an adjacent surface contacting one of said first or second sides.

2. The highly manipulatable weight plate according to claim 1, wherein said recess is sufficient large to receive four fingers of a typical adult male human.

3. The highly manipulatable weight plate according to claim 1, wherein said disk body further includes a first raised flange located adjacent the periphery of said disk body and extending in a generally axial direction with respect to said central axis.

4. The highly manipulatable weight plate according to claim 3, wherein said one recess is formed by a notch contained in said first raised flange.

5. The highly manipulatable weight plate according to claim 3, wherein said disk body further includes a second raised flange located adjacent the periphery of said disk body and extending generally in an axial direction opposite to said first raised flange.

6. The highly manipulatable weight plate according to claim 5, wherein said disk body contains at least two said recesses with the second said recess being formed in said second raised flange.

7. The highly manipulatable weight plate according to claim 6, wherein the second said recess is formed by a notch contained in said second raised flange.

8. The highly manipulatable weight plate according to claim 7, wherein each recess formed in said first raised flange has an opposing recess formed in said second raised flange.

9. The highly manipulatable weight plate according to claim 8, wherein said disk body contains at least one first pair of said recesses located 180 degrees apart from one another formed in said first raised flange and at least a second pair of said recesses located 180 degrees apart from one another formed in said second raised flange.

10. The highly manipulatable weight plate of claim 1, wherein said first and second circumferential edges are substantially circular, said first side is generally planar and said disk body further includes a first raised flange located adjacent the periphery of said disk body, said first raised flange extending in a generally axial direction with respect to said central axis.

11. The highly manipulatable weight plate of claim 10, wherein said second side is generally planar and wherein said disk body includes first and second pairs of said recesses, said first pair of said recesses being located 180 degrees apart from one another opening radially into said periphery surface and axially into said first side, and said second pair of said recesses being located 180 degrees apart from one another opening radially into said periphery surface and axially into said second side.

12. The highly manipulatable weight plate according to claim 10, wherein said disk body contains at least one first pair of said recesses located 180 degrees apart from one another formed in said first raised flange and at least a second pair of said recesses located 180 degrees apart from one another formed in said disk body opening axially into said first side and radially into said periphery surface.

13. The highly manipulatable weight plate according to claim 10, wherein said one recess is formed by a notch contained in said first raised flange.

14. The highly manipulatable weight plate according to claim 3, wherein said first raised flange has a radial width $W_f$ that is substantially the same about the perimeter of said first side.

15. A highly manipulatable weight plate for use in human exercise, comprising:

a disk body having a mass sufficient to generate a human movement resistance force when employed in human exercise and containing at least one internally located bore having a central axis for receiving a disk body mounting apparatus, said disk body including first and second generally opposed sides oriented generally radially with respect to said central axis and terminating in first and second circumferential edges, respectively;

an outer periphery surface extending between said first and second circumferential edges of said first and second sides; and gripping means for allowing a human to simultaneously place a plurality of his fingers radially inwardly of said first circumferential edge of said first side wherein said gripping means includes a recess having a central axis intersecting the central axis of said internally located bore, said gripping means is sufficiently large to receive four fingers of a typical adult male human so that the fingers can apply an axial force against said disk body to displace the disk body away from an adjacent flat surface contacting said second side said gripping means includes a recess contained in said disk body which opens into said peripheral surface but does not extend into the internally located bore.

16. The highly manipulatable weight plate of claim 1, wherein said recess opens solely into said periphery surface to allow radial insertion of four fingers of a typical adult male human therein so that the fingers can apply an axial force against said disk body in either of two opposite axial directions in order to displace the disk body away from an adjacent surface contacting one of said first or second sides depending on the direction required to move the disk body away from the contacting surface.

17. The highly manipulatable weight plate according to claim 1, wherein said bore is located at the center of said disk body.

18. The highly manipulatable weight plate according to claim 4 wherein said first raised flange has an axial extent $H_f$ and wherein said recess contained in said raised flange has a depth D that is less than axial extent $H_f$ so that a lip having an axial extent less than $H_f$ is located adjacent to said recess to allow the fingers to apply an outward radial force against said disk body to aid in grasping said disk body.

19. A highly manipulatable weight plate according to claim 15, wherein said gripping means includes a recess contained in said disk body and opening into said periphery surface.

* * * * *

UNITED STATES PATENT AND TRADEMARK OFFICE

CERTIFICATE OF CORRECTION

PATENT NO. : 5,853,355
DATED : December 29, 1998
INVENTOR(S) : Victor J. Standish It is certified that error appears in the above-identified patent and that said Letters Patent is hereby corrected as shown below:

Column 7,
Line 1, after "recess" insert -- which does not extend radially inward to the internally located bore --.

Signed and Sealed this

Fifth Day of August, 2003

JAMES E. ROGAN
*Director of the United States Patent and Trademark Office*